US005232188A

United States Patent [19]

Troncone

[11] Patent Number: 5,232,188

[45] Date of Patent: Aug. 3, 1993

[54] MIXING PAIL JIG

[76] Inventor: George Troncone, 250 Hurd St., Fairfield, Conn. 06430

[21] Appl. No.: 974,973

[22] Filed: Nov. 12, 1992

[51] Int. Cl.[5] ..... A47G 23/02

[52] U.S. Cl. ..... 248/154; 248/500

[58] Field of Search ..... 248/146, 154, 351, 346, 248/500, 501, 315, 316.4, 316.5, 310, 237, 152

[56] References Cited

U.S. PATENT DOCUMENTS

| | | | |
|---|---|---|---|
| 752,968 | 2/1904 | Gatterer | 248/105 |
| 825,248 | 7/1906 | Silver | 248/146 |
| 1,338,106 | 4/1920 | Smith | 248/346 |
| 1,885,788 | 11/1932 | Westburg | 248/500 |
| 2,442,723 | 6/1948 | Economakis | 248/174 X |
| 2,563,698 | 8/1951 | Whitebread | 248/154 |
| 2,715,005 | 8/1955 | Hildebrand | 248/154 |
| 2,803,418 | 8/1957 | Smith | 248/154 |
| 3,545,709 | 12/1970 | Harvey | 248/146 |
| 4,955,573 | 9/1990 | Horvath | 248/154 X |

*Primary Examiner*—Ramon O. Ramirez
*Assistant Examiner*—Korie H. Chan
*Attorney, Agent, or Firm*—Abelman Frayne & Schwab

[57] ABSTRACT

A jib, for use in supporting a pail during a mixing operation to be carried out within the pail, includes a support ring which is distorted into an elliptical condition, thus relying on the interfitment of two members of elliptical form to prevent rotation of the pail relative to the jig.

6 Claims, 1 Drawing Sheet

MIXING PAIL JIG

FIELD OF THE INVENTION

This invention relates to a readily portable jig that can be easily moved by a workman to any desired location, and which then is employed to securely hold a conventional bucket or pail in such a manner that relative rotation between the jig and the pail is inhibited. This permits the contents of the pail to be mixed using a powered mixing device, in the total absence of rotation of the pail about the longitudinal axis thereof, or, oscillation of the base of the pail relative to the supporting substrate.

BACKGROUND OF THE INVENTION

In the construction industries, it commonly occurs that buckets or pails of pre-mixed compounds require to be stirred and blended to a homogenous consistency prior to the use of that compound.

Such compounds include pre-mixed cement, paints, wallboard compound, vinyl adhesive, vinyl mastic compound employed for installing wall or floor tile, tile grouting compound, thin-set mortar, and the like. Commonly, such compounds are supplied in two gallon and five gallon pails that have been molded from plastics material, commonly the plastics materials being of a low-grade vinyl that has been weighted with additives.

In the production of such pails, of necessity a draft taper angle must be provided on the cylindrical side wall of the pail in order to permit freeing of the molded pail from the molding dies after the molding of the pail, the cylindrical side wall of the pail, while appearing to the eye to be truly cylindrical, in fact being in the shape of an inverted frustrum of a cone. Also, while barely perceptible, such pails, when filled with compound bulge outwardly to a small extent.

Mixing of the contents of such pails is commonly required before use of the contained compound. Additionally, after the contained compound has been used up, such pairs commonly are employed for mixing other compounds, such as Portland cement, gypsum plaster, sand or mud coat, etc., such as commonly are employed in the masonry and plastering arts.

The common practice in mixing the contents of such pails is to place the pail on a stable substrate, which commonly is a subflooring, and for the workman then to stand astride the pail, and grip the upper edge of the pail between the user's lower legs, thus to prevent oscillation and rotation of the pail during the mixing of the contents thereof. The mixing is commonly performed by a paddle attached to a high-powered hand drill, typically a five horsepower drill, as is commonly employed in the construction industry.

If the workman does not grip the pail between the workman's lower legs prior to effecting the mixing of the contents, the pail will rotate in the same direction as the direction of mixing, and then will commence to oscillate about the lower surface of the pail in an entirely uncontrolled manner. This can result in the contents of the pail being discharged onto the workman's clothes and onto the floor in a random and totally uncontrolled manner.

When the pail is gripped between the workman's lower legs, rotation of the pail and oscillation thereof relative to the supporting substrate is reduced to an acceptable level or even eliminated. If, however, the workman relaxes his grip on the pail, then, the pail can rapidly spin, causing damage and injury to the workman's lower legs by impacting of the bails of the pail onto the workman's shinbones, a situation which results in great discomfort to the workman.

The compound to be mixed vary from a relatively thin consistency, such as in paints, to a very heavy consistency, such as in vinyl mastic compound, roofing compound and tile grout, the stirring of such materials requiring very considerable gripping by the workman's lower legs, which can cause bruising of the tissue of the workman's legs.

The need to clamp the pail between the workman's lower legs, in turn results a need to shorten the supporting shank of the paddle employed in the mixing operation, in order that the workman can assume a semi-crouched position during mixing of the contents of the pail. Not only is this uncomfortable to the workman, but also, has the most undesirable requirement of moving the workman's face into closer proximity with the compound being mixed, with an increased probability of the compound being spattered onto the workman's face and upper clothing during the mixing operation.

Additionally, situations can arise in which a pail is required to be supported in a manner that will prevent accidental tipping of the pail by accidental impacts thereon. This is particularly when employing highly corrosive materials such as muriatic acid, that material commonly being employed for cleaning down brick, cement, stone, and tile work after the installation thereof.

SUMMARY OF THE INVENTION

An object of this invention is to provide a supporting jig for such a pail that will hold the pail against rotational movement, and thus, against oscillatory movement, and which does not require the pail to be clamped between the workman's lower legs, the jig also being employable in situations where support of a pail is required to prevent accidental tipping over of the pail.

An additional object is to provide a jig for the support of a pail that can readily be attached to roofing by the use of a tack nail, and then be employed for supporting a pail of roofing compound, and which will provide stable support for a pail of roofing compound when placed on an inclined roof of considerable pitch angle.

THE INVENTIVE CONCEPT

According to the present invention, a jig is provided for the support of a conventional pail of a specific volume, such as a two gallon, five gallon or ten gallon pail of the type commonly employed in the construction industry.

The jig includes a ring-shaped member of generally circular form, which is supported on a first diameter by a floor-engaging support, and which is provided on a diameter at right-angles to said first diameter with foot pads that normally are spaced above the supporting substrate, but which can be forced downwardly into contact with the supporting substrate by a workman standing on the respective foot pads The ring-shaped member at that time becomes distorted by a minor extent out of a truly planar substantially circular condition into one in which the ring becomes bowed and elliptical in planform.

Preferably, but not essentially, the ring is slightly elliptical prior to stressing of the ring in order for it to provide an initial grip on the pail prior to the workman standing on the ground engaging feet. The elliptical configuration of the ring then becomes increased by the weight of the workman, thus to trap and hold the pail within the jig in a condition in which the pail itself is distorted slightly out of a truly circular condition to a slightly elliptical condition, the interfitment one within the other of two elliptical forms then precluding the rotation of one of those forms relative to the other.

If the supporting ring is initially elliptical, this has the great advantage that even in the event that a workman is not standing on the ground engaging feet, rotation of the pail relative to the jig is precluded. This is particularly useful to roofers who can be working on a highly pitched roof, and, who will be removing compound from the pail using an arcuate sweeping motion of a spreader or trowel. In such usage, the jig can be tack-nailed to the roof, thus precluding the pail from sliding downwardly on the pitched roof, and also, precluding rotational movement of the pail caused by removal of compound from the pail by a circular sweeping motion of a spreader or trowel.

The invention will now be described with reference to the accompanying drawings, which illustrate preferred embodiments of the invention, and, in which:

DESCRIPTION OF THE PREFERRED EMBODIMENT

Figure 1:
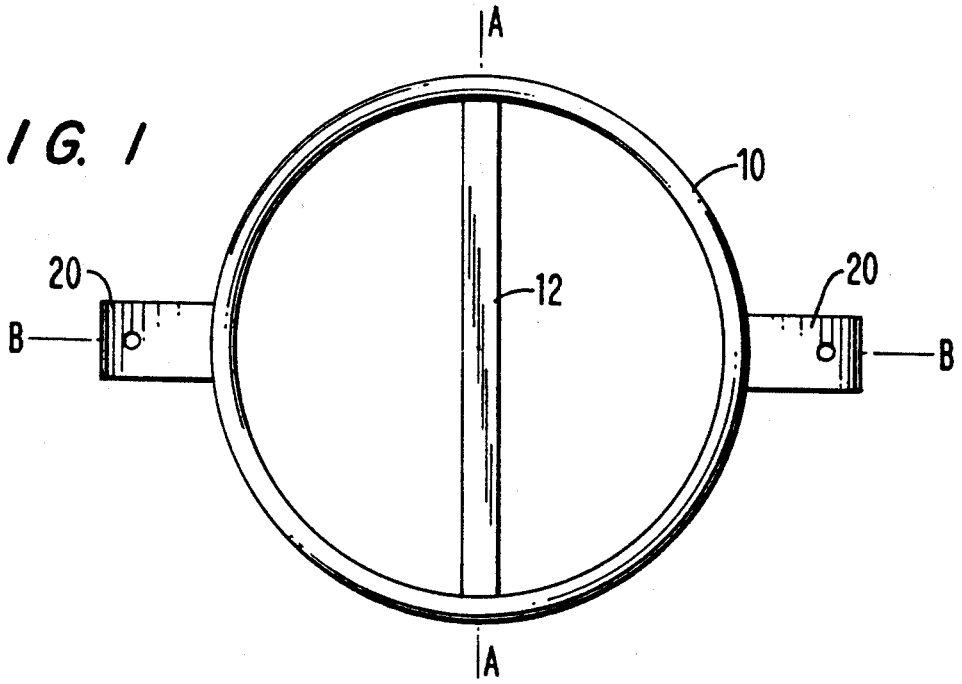
FIG. 1 is a diagrammatic plan view of the jig of the invention.
Figure 2:
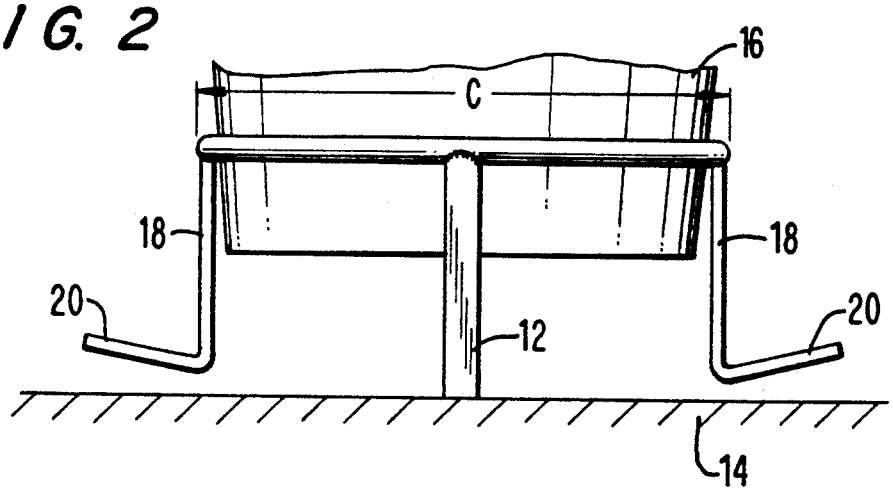
FIG. 2 is a diagrammatic side view of the jig of the invention prior top stressing of the jig.

Referring firstly to FIGS. 1 and 2, the jig of the invention is comprised of a ring 10 having a diametrically extending U-shaped foot 12, which is provided for supporting the jig on a substrate 14.

The upwardly extending arms of the U-shaped foot 12 are rigidly secured to the ring 10 in any convenient manner, such as by welding.

The ring 10 preferably, but not essentially, is not truly circular in planform, but, is slightly elliptical, the major axis of the ellipse preferably lying on the lines A—A, and the minor axis of the ellipse preferably lying on the line B—B of FIG. 1 and at right angles to the line A—A. Typically, for a 5 gallon pail, the dimension on the line A—A will be 28 mm, and the dimension on the line B—B will be 27.5 mm. Due to the fact that the pail is formed of a stiff but slightly flexible plastics materials, if a pail is inserted into the ring 10 by lowering it downwardly into the ring as illustrated in FIG. 2, the ring 10 will initially engage the side wall of the pail at points along the line B—B. As the pail is lowered further into the ring and presents an increasing circumferential dimension to the ring 10, the pail progressively is flexed from its initial truly circular condition to an elliptical condition. The pail thus becomes fixed in dimension by the ring 10 along the B—B axis, and then is forced to expand outwardly along the A—A axis until such time as the entire circumference of the pail becomes engaged in continuous line engagement with the inner periphery of the ring 10. In all instances, the ring 10 is dimensioned such that the pail 16 remains spaced from the foot 12 when the pail is fully inserted into the ring 10.

At that point, the inner pheriphery of the ring 10 and the external periphery of the pail 16, which has been distorted into an elliptical shape corresponding with that of the ring 10, provide intimately interfitted ellipses, which, preclude rotation of the pail within the ring 10. The restraint on relative rotation is primarily due to the interfitted non-circular shapes, the frictional restraint imposed by the ring against rotation of the pail within the ring being of insignificant.

Even prior to stressing and distortion of the ring 10, an extremely strong interfitment is developed between the ring 10 and the pail 16 that resists attempted rotation of the pail relative to the ring 10 to an entirely surprising extent, that extent greatly exceeding the restraint exerted on the pail by the frictional engagement alone with the ring.

The next, and most surprising result is that whereas relative rotation between the pail 12 and the ring 10 has been precluded in its entirety, the pail 16 does not become jammed within the ring 10, but can easily be removed from the ring 10 merely by lifting the pail vertically out of the ring.

This securement of the pail within the ring is further enhanced to a surprising greater extent by distorting the ring 10 out of its initial planar condition as illustrated in FIGS. 1 and 2 by downwards bowing of the ring 10. The means for bowing the ring out of its truly planar condition is provided by downwardly extending struts 18 that are secured to the ring 10 at points on the axis B, the struts 18 terminating at their lower ends in outwardly and preferably upwardly inclined foot pads 20, which preferably are arranged at an angle of 2 and 5 degrees to the horizontal.

Figure 3:
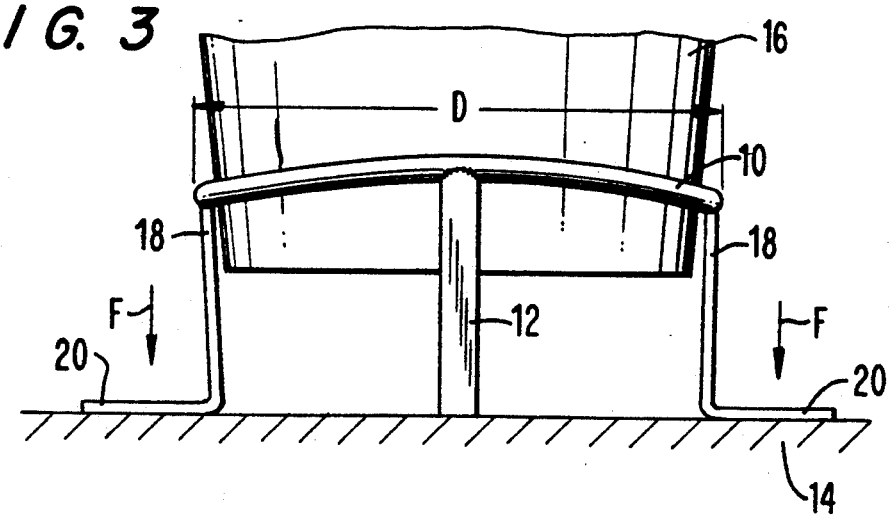
FIG. 3 is a diagrammatic view of the jig showing the jig when in a stressed condition.

If now a workman places his feet on the respective foot pads 20, and applies his body weight thereto, as indicated by the arrows F,F in FIG. 3, then, the ring 10 is flexed and bowed downwardly on opposite sides of the axis A—A. In being so flexed, the effective diameter of the ring 10 along the axis B—B progressively decreases from the diameter C along the B—B axis as illustrated in FIG. 2, to a lesser diameter D along the B—B axis, as illustrated in FIG. 3, and as is also illustrated by the chain dotted lines 20 in FIG. 1.

Thus, the ring 10 is flexed and forced into a condition in which the diameter along the B—B axis is further decreased, and, the difference in diameters along the A—A axis and the B—B axis is further increased, with a consequence that the pail is moved even further into out of round, and, the gripping force exerted on the pail 16 by the ring 10 is even further increased. The interference fit of the pail 16 within the ring 10 is thus increased to such a surprising extent that even extremely viscous materials contained within the pail 16, such as mastic or roof compounds, can be mixed within the pail by the use of a rotary mixer, and this in the total absence of any rotational slippage of the pail relative to the ring 10.

At the time a workman is standing on the foot pads 20, the ring 10 is then held against rotation by the engagement of the footpads 20 with the substrate 14, and, in addition, by the frictional engagement of the U-shaped foot 12 with the substrate 14.

Surprisingly, if the workman has now completed the mixing operation, and wishes to remove the pail 16 from the jig, instead of having to hammer the jig downwardly off the pail 16 as one would expect, the jig can easily be removed from the pail merely by lifting the pail with one hand vertically, and optionally placing one foot on one of the foot pads 20. This provides great convenience to the workman , who at that time in all probability is holding the mixing equipment in the other of his hands. Typically, the mixing equipment will be comprised of a high torque drill, such as a five horsepower hand drill commonly used in the construction industry, which has the shank of a mixing paddle or mixing screw secured in the chuck thereof. As such equipment is well-known in the art and in common usage, no illustration is provided in the drawings.

While the jig can be fabricated of any material having an inherent memory of its initial shape, it is preferred that the ring 10 at least can be made of iron or steel, in that it is to be expected to be subjected to extremely rough usage. Similarly, the U-shaped foot 12 is preferably formed from iron or steel, thus enabling it to be welded to the ring 10 in an extremely strong interconnection of the arms of the foot 12 and the ring 10. The struts 18 and foot pads 20 similarly are preferably formed from iron or steel, thus enabling them to be welded to the ring 10.

Due to the fact that the pail 16 is securely supported within the jig, particularly when the workman's feet are placed on the foot pads 20, it is no longer necessary for the workman to grip the pail between the workman's lower legs, thus greatly increasing the comfort of the workman, and, removing the possibility of bales of the pail 16 impacting on the worker's shinbones, such as can occur in the prior art if the workman inadvertently releases the pressure exerted by the workman's lower legs.

Further, the requirements for the workman to assume a crouching position during the mixing operation is no longer necessary, with the consequence that shortening of the shank of the paddle, as previously was found necessary in the prior art, also becomes totally unnecessary, the workman being able to stand completely erect while effecting the mixing operation, at which time the workman's face is removed from the material being mixed to the greatest possible extent.

The jig of the invention while being primarily of utility in effecting mixing operations, also finds utility in other construction operations. One particular use is that it provides a stable support for the pail 16 in the event that the pail is employed for containing corrosive materials such as muriatic acid. Further, the jig of the invention finds particular utility when used on a roof having a pitch angle, in which situation the foot pads 20 can be tack-nailed to the roof, a pail containing roofing compound then not only being securely attached to the roof, but also being securely held against rotation relative to the jig under the force of removal of the contents of the pail by a circular movement of a spreader or trowel, such as is commonly employed by a workman when effecting a roofing operation.

While the formation of the ring 10 as an ellipse having its major axis lying along the line A—A is preferable, in that the pail is then secured without regard to whether a workman is standing on the foot pads 20, if it is contemplated that the workman always will stand on the footpads 20 while effecting a mixing operation, then, the ring 10 initially can be truly circular.

Additionally, while it is believed to be completely unnecessary, the ring 10 can be serrated or otherwise roughened on its inner periphery, to even further increase the grip on the pail 16, both prior to a workman standing on the foot pads 20 and while the workman is standing on the footpads 20.

As the jig of the invention is likely to be used in locations having relatively poor lighting, preferably the jig is painted in a highly light-reflective color, such as chrome, yellow, bright orange, or any other suitable color that will render the jig clearly apparent in dim lighting, and, reduce the possibility of a workman accidentally tripping over the jig when its is not being used for a mixing operation.

What is claimed is:

1. A jig, particularly for use in supporting a pail on a surface during a mixing operation by a workman comprising:

a ring-shaped member for having an inner periphery for engagement with an external peripheral surface of said pail;

a U-shaped foot having a pair of arms connected by a bridge, each of said arms having axial length is rigidly secured to said ring-shaped member on opposite ends of a first diameter of said ring-shaped member bridge of said U-shaped foot being intended for engagement with said surface; and, struts having axial length is attached to said ring-shaped member on opposite ends of a second diameter of said ring-shaped member intermediate said arms of said U-shaped foot, said struts being intended to stabilize said foot against tipping over about the axis of said bridge;

said struts terminating at lower ends of said struts in radially outwardly extending foot pads;

said arms of said U-shaped foot being of greater axial length than the axial length of said struts;

whereby, when said workman stands on said respective footpads, said ring-shaped member is bowed and distorted out of an initial condition into an elliptical condition when viewed axially of said ring-shaped member.

2. The jig of claim 1, in which said ring-shaped member initially is elliptical in planform, the major axis of said ellipse extending between said arms of said U-shaped foot, whereby, said pail can be secured against rotation located within said ring-shaped member prior to a workman standing on said foot pads.

3. The jig of claim 1, in which said foot pads of said struts diverge upwardly from said struts in a direction towards the plane of said ring, whereby said foot pads are stressed downwardly into horizontal alignment with said surface when a workman stands on said foot pads, thus further enhancing distortion of said ring-shaped member from a truly circular condition into an elliptical condition when viewed in plan view axially of said ring-shaped member.

4. The jig of claim 1, in which said jig is comprised of ferrous material.

5. The jig of claim 1, in which said ring-shaped member has serrations on said inner periphery of said ring-shaped member.

6. The jig of claim 2, in which the initial elliptical configuration of said ring is operative to force a pail into an identical elliptical configuration, thus inhibiting relative rotation between said pail and said ring by the interfitting of two elliptical forms, whereby the restraint against relative rotation between said pail and said ring is produced dominantly by the interfitting of non-circular forms one within the other, and to a lesser extent by the frictional engagement of said pail with the inner circumference of said ring.

* * * * *